US005169337A

United States Patent [19]

Ortega et al.

[11] Patent Number: 5,169,337

[45] Date of Patent: Dec. 8, 1992

[54] ELECTRICAL SHUNT

[75] Inventors: Jose L. Ortega, Camp Hill; David A. Griesemer, Harrisburg, both of Pa.

[73] Assignee: AMP Incorporated, Harrisburg, Pa.

[21] Appl. No.: 755,420

[22] Filed: Sep. 5, 1991

[51] Int. Cl.[5] ..... H01R 31/08

[52] U.S. Cl. ..... 439/510; 439/514

[58] Field of Search ..... 439/507, 509-514

[56] References Cited

U.S. PATENT DOCUMENTS 4,482,198 11/1984 Crowley ..... 439/514

4,790,773 12/1988 Hahn ..... 439/682

OTHER PUBLICATIONS

AMP Data Sheet 80-603, Issued Jun. 1981.

AMP Instruction Sheet No. 3230, Released Feb. 20, 1990.

DuPont Bulletin 6280, Dated Apr. 21, 1988.

*Primary Examiner*—Paula A. Bradley

[57] ABSTRACT

A shunt (10) for commoning a pair of posts is disclosed. The shunt (10) includes a housing (12) having a commoning element (14) in a chamber (30). Openings (32, 40) through opposite ends (20, 22) provide access to the element (14) which has fins (82) on one end member (72) and ears (84) on another end member (74) cooperating with the chambers surfaces (26*a*, 66) to prevent misaligned posts from being inserted beneath the element (14).

3 Claims, 6 Drawing Sheets

ELECTRICAL SHUNT

FIELD OF THE INVENTION

The present relates to a two position electrical shunt for use in shunting or commoning a pair of electrical posts such as are on an electrical posted header.

BACKGROUND OF THE INVENTION

Shunts are well know in the art. For example, AMP Incorporated of Harrisburg, Pa. has been making and selling shunts since at least as early as 1981. The Berg Division of the DuPont Company also makes and sells shunts. Whereas shunts are relatively simple devices to use, some care is required to prevent damage to the commoning element by incorrect positions of the shunt on posts or misdirected insertion of posts into the shunt. Accordingly it is now proposed to provide a shunt which includes features designed to prevent damage to the commoning element.

SUMMARY OF THE INVENTION

According to the present invention, an electrical shunt is provided. The shunt includes a housing having a chamber, openings thereinto through opposite end walls and bosses positioned on one surface of the chamber. The shunt further includes a commoning element positioned in the chamber and having parallel end members and parallel contact members extending between and attached to the end members. The arcuate-shaped contact members pass over the bosses and engage them when depressed by an inserted post to prevent being overstressed.

DESCRIPTION OF THE INVENTION

Figure 1:
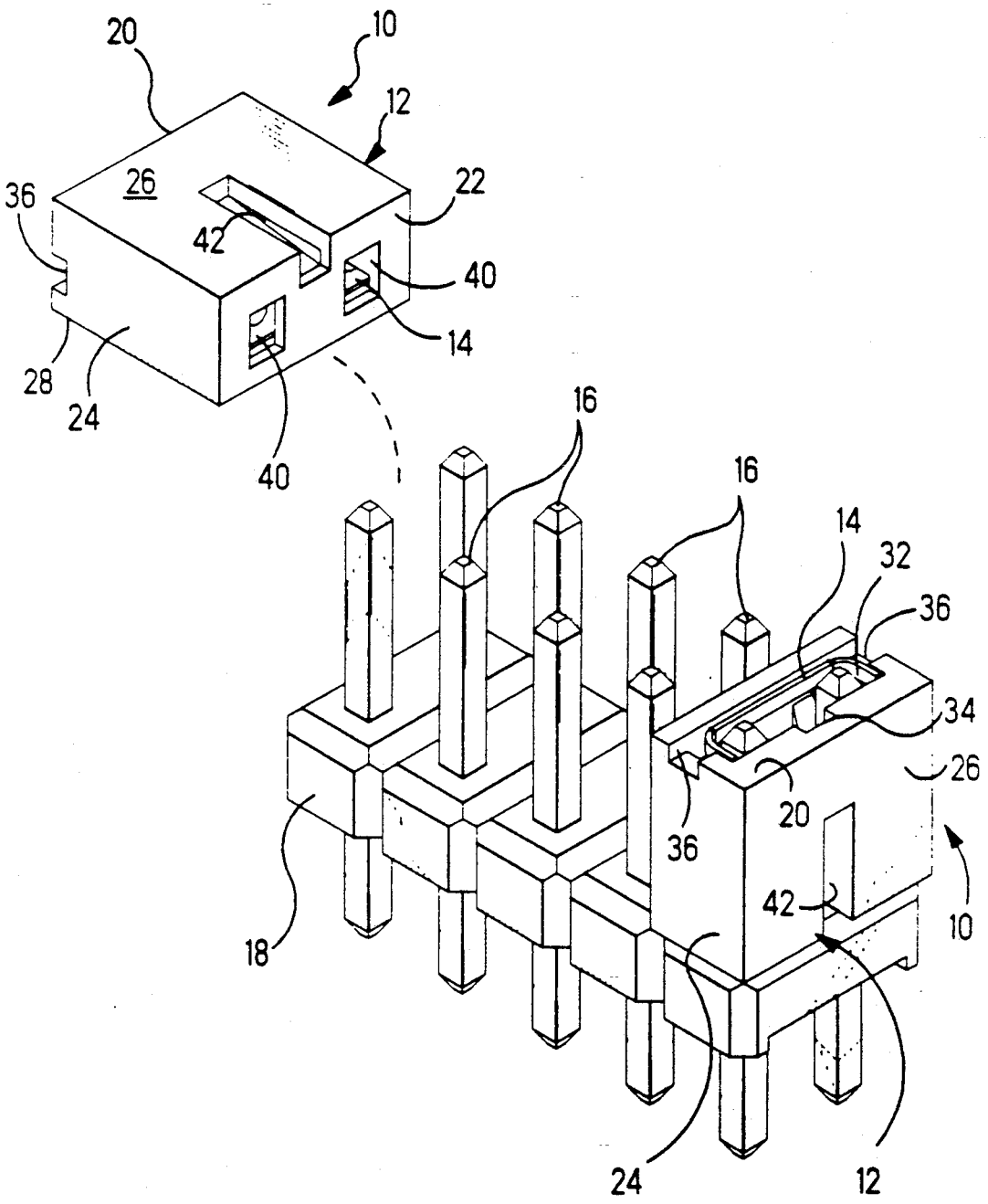
FIG. 1 is a View showing a posted header and two shunts of the present invention, one exploded from the header and the other mounted thereon.

With reference to FIG. 1, shunt 10 of the present invention includes housing 12 and commoning element 14. The basic function or utility of shunt 10 is to common a pair of posts 16, as for example on header 18.

Housing 12 is molded with a suitable plastics material such as a glass-filled polyester.

Figure 2:
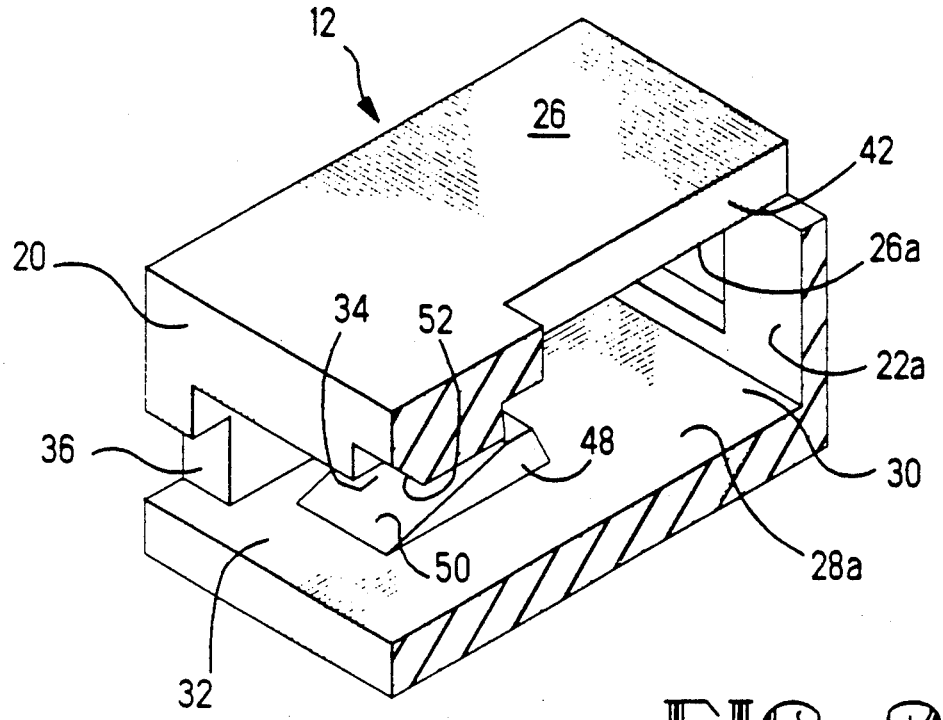
FIGS. 2 and 3 are views showing the interior of the shunt housing.

Housing 12 is defined by endwalls 20,22, side walls 24 and base walls 26,28. The letter "a" following these reference numerals indicate the interior surfaces of these walls which defines housing chamber 30 (FIG. 2).

Opening 32 provides access to chamber 30 through end wall 20 and as shown, extends there-across to side walls 24. Groove 34, midway across opening 32 and notches 36 are also provided in end wall 20.

Two smaller openings 40 provide access to chamber 30 through opposite end wall 22.

Slot 42 in surface wall 26 extends from end wall 22 towards end wall 20 but terminates about half way there. Further, as shown in FIG. 2, slot 42 is open to chamber 30.

Figure 3:
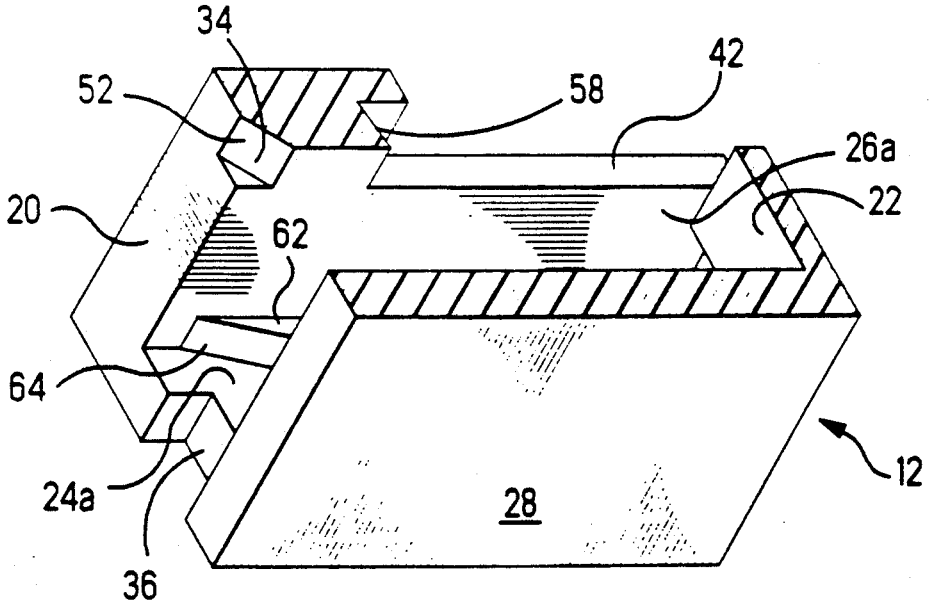

Housing 12 and more particularly chamber 30 therein is shown in FIGS. 2 and 3. These views show one-half of the housing with the longitudinal cut being centered between side walls 24.

With reference to FIG. 2, bosses 48 on surface **28*a* near each surface 24*a* are provided with a ramp 50 which extends obliquely towards end wall 22*a* and opposite surface 26*a***.

Groove 34 includes a slanted floor 52 which slants into chamber 30 from end wall 20.

With reference to FIG. 3, slot 42 in surface 26 stops short of end wall 20 to provide shoulder 58. As shown, groove 34 and shoulder 58 are in alignment with each other.

Positioning members 62 are provided on surface **26*a* and up against both surfaces 24*a*. As shown more clearly in FIG. 10, members 62 include a ramp 64 which slants toward opposite surface 28*a* and end wall 22*a* and a straight portion 66 which is parallel with surface 28*a***.

Figure 4:
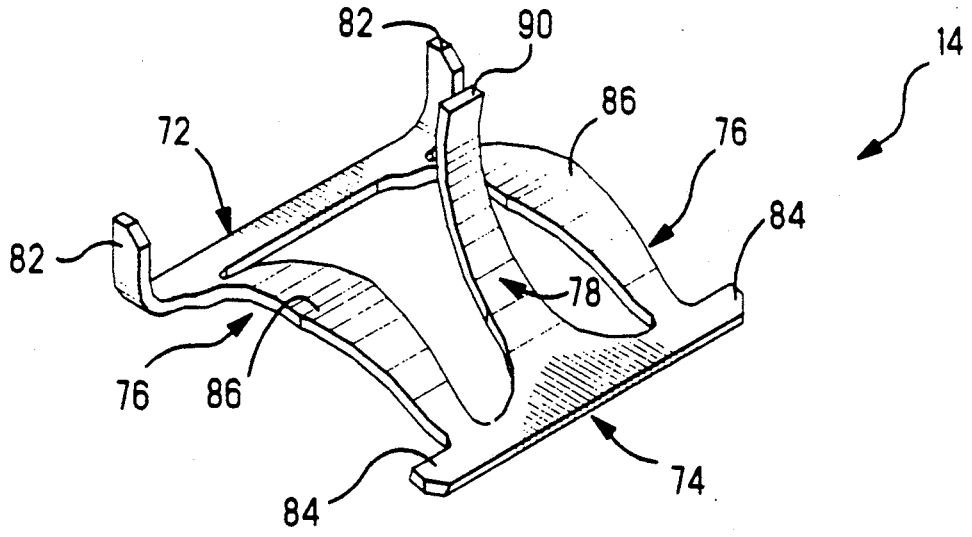
FIG. 4 is a view of the shunt's commoning element.

Commoning element 14, shown in FIG. 4 is stamped and formed from a suitable copper alloy spring temper metal. This frame-shaped element 14 includes parallel end members 72,74, parallel contact members 76 extending between end members 72,74 and retention finger 78.

End member 72 includes free end portions which are formed up ninety degrees to provide fins 82. Opposite end member 74 includes coplanar ears 84 which extend outwardly of contact members 76.

Contact members 76 are arcuate shaped to provide a convex contact surfaces 86. Further, the width of each member 76 is greatest mid-way between end members 72,74 and narrowest where they join the end members.

Retention finger 78 is attached to end member 74 between contact members 76 and curves outwardly therefrom with the curvature being in the same direction as the arching of members 76. Finger 78 is widest at the point of attachment and narrows uniformly out to free end 90.

Figure 5:
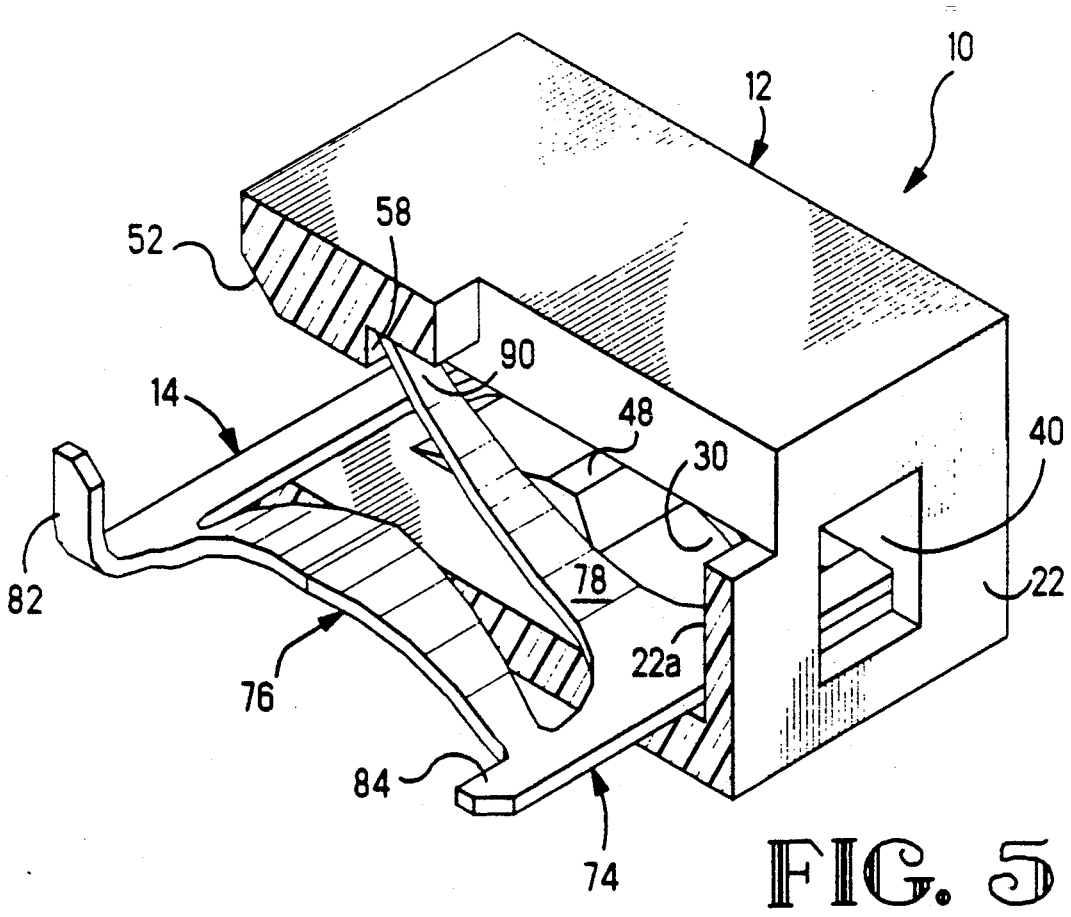
FIG. 5 is a partly sectioned view showing the commoning element in the housing.

FIG. 5 is a view showing element 14 in housing 12 forming shunt 10. Element 14 is loaded into chamber 30 through opening 32 with each contact member 76 in line with respective smaller openings 40 and over respective bosses 48. In the process of loading element 14 into chamber 30, ears 84 ride down ramps 64 and into the space between surface **28*a* and straight portion 66. Finger 78, during insertion, slides down slanted floor 52 and springs up into groove 56 with free end 90 being behind shoulder 58**.

Element 14 is retained in chamber 30 by free end 90 of finger 78 abutting shoulder 58 and by end member 74 abutting surface **22*a*. Thus, to back element 14 out, finger 78** must be depressed.

Figure 6:
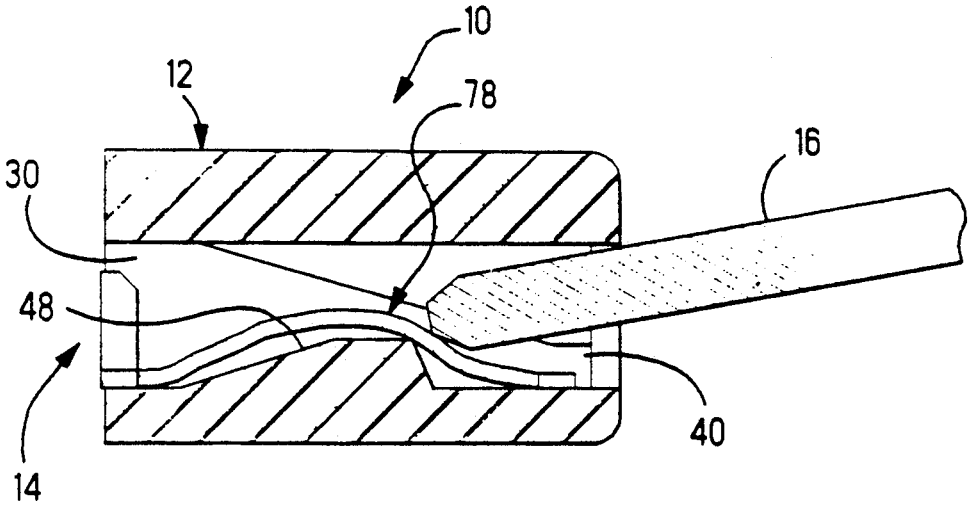
FIGS. 6 and 7 are views illustrating one feature of the present invention.
Figure 7:
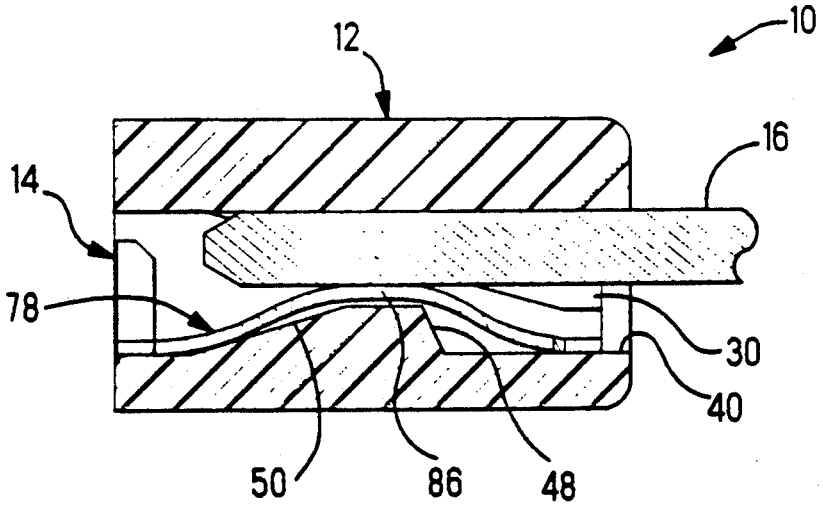

FIGS. 6 and 7 illustrate the features of bosses 48. As a misaligned post 16 enters chamber 30 through an opening 40, it engages a contact member 76 and tries to push element 14 out. Boss 48, as shown in FIG. 6, prevents that, causing post 16 to assume a more aligned position as shown in FIG. 7. Then, as post 16 is further inserted, it slides across contact surface 86 and depresses member 78 down towards boss 48 which now preforms an anti-over-stress function.

As contact members 76 are depressed,the over-all length of element 14 increases as a comparison between FIGS. 6 and 7 will indicate.

Figure 8:
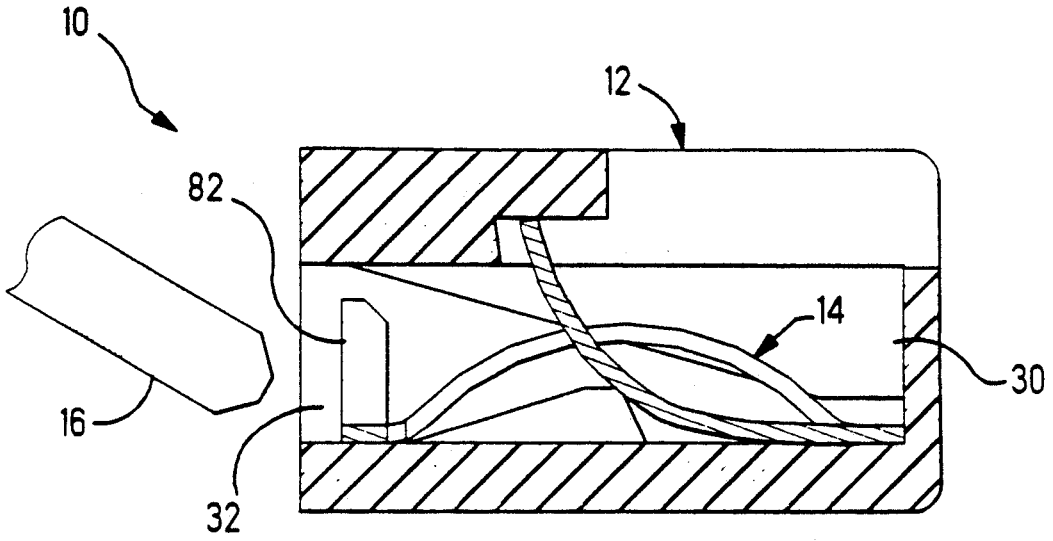
FIGS. 8 and 9 are views illustrating another feature of the present invention.
Figure 9:
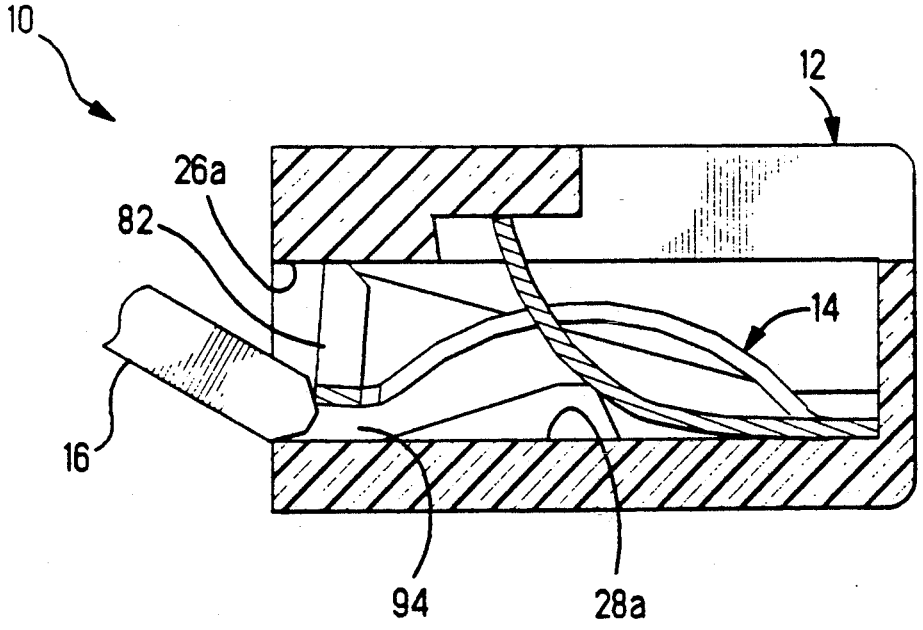

FIGS. 8 and 9 illustrate the advantageous feature of fins 82 on end member 72. A misaligned post 16 is being inserted into chamber 30 through opening 32 such that it digs in under end member 7 and as shown in FIG. 9, tries to slide in under element 14. In doing so, element 14 is lifted up. However, the space between element 14 and surface 28*a*, indicated by reference numeral 94 is limited to less than the post size by fins 82 abutting surface 26*a* as shown in FIG. 9.

Figure 10:
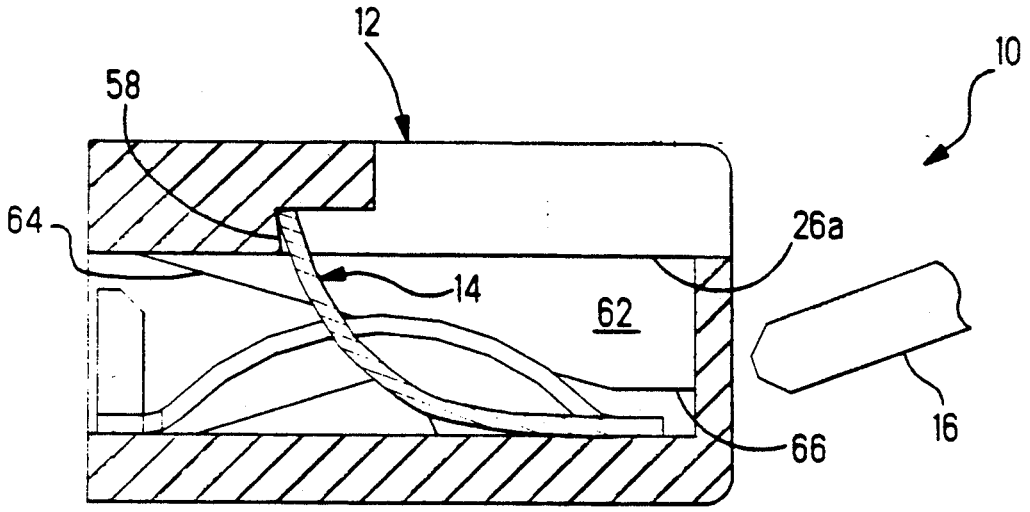
FIGS. 10 and 11 are views illustrating a third feature of the present invention.
Figure 11:
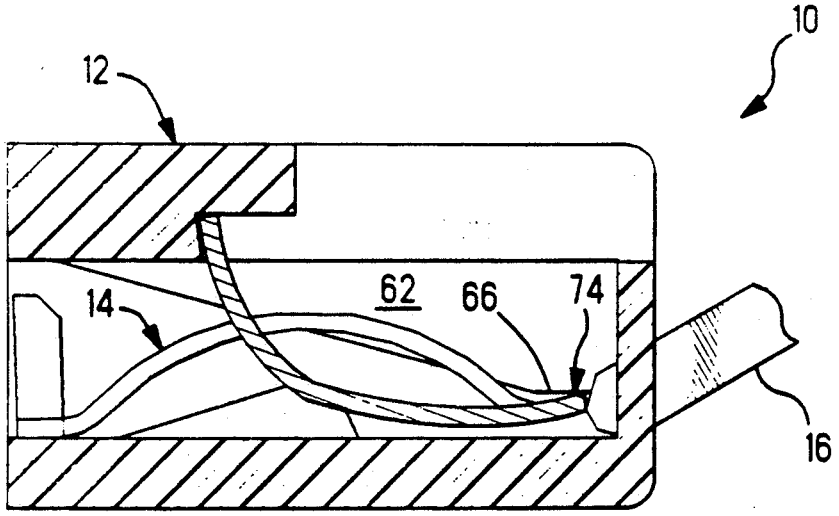

A similar situation to that just described can occur with a misaligned post 16 entering chamber 30 through an opening 40 as shown in FIG. 10. As post 16 enters, it hits end member 74 and, as shown in FIG. 11, attempts to lift element 14 and slide thereunder. However ears 84 (shown in FIG. 4), on the ends of member 74 abut portion 66 on cams 62 and prevent further lifting of element 14.

As can be discerned, an electrical shunt has been disclosed. The shunt includes a housing having a chamber with openings thereto and a frame-shaped commoning element in the chamber. The housing, in cooperation with the element, provides several advantageous features not available in prior art shunts. These features include fins and ears on the element which abut certain surfaces in the chamber to prevent a misaligned mating post from sliding in under the element. Further, bosses in the chamber cooperate with the element to prevent over-stressing the contact members.

I claim:

1. An electrical shunt for commoning a pair of posts,-comprising:

a housing having a chamber, openings thereto through opposite end walls and means in said chamber for preventing over-stressing; and a frame-shaped commoning element having parallel end members and parallel contact member extending between and attached to said end members, said contact members being arcuate and passing over said means in said chamber and engageable therewith upon being depressed thereagainst so that said contact members cannot be over-stressed, said shunt including means on an end member of said element, in cooperation with a surface of said chamber, for preventing a misaligned post from being inserted beneath said element.

2. The shunt according to claim 1 wherein said means for preventing a misaligned post comprises a fin or ear extending from said element adjacent said surface.

3. The shunt according to claim 1 wherein said means for preventing a misaligned post comprises a fin extending from one of said end members at substantially a right angle thereto.

* * * * *